US005418338A

United States Patent [19]

Kim

[11] Patent Number: 5,418,338

[45] Date of Patent: May 23, 1995

[54] ADJUSTABLE SPEAKER BOX

[76] Inventor: Chae Y. Kim, 1245 St. Andrews Ct., Ontario, Calif. 91761

[21] Appl. No.: 287,932

[22] Filed: Aug. 9, 1994

[51] Int. Cl.[6] ..... A47B 81/06

[52] U.S. Cl. ..... 181/199; 381/159

[58] Field of Search ..... 181/199, 155, 156, 143, 181/141; 381/90, 158, 159, 160

[56] References Cited

U.S. PATENT DOCUMENTS 5,304,747 4/1994 Hale, II ..... 181/156

*Primary Examiner*—Khanh Dang

[57] ABSTRACT

A speaker box with pivotally installed divider providing an adjustable volume. One embodiment is a large, rectangularly shaped wooden speaker box which is centrally partitioned into two separate chambers, each of which houses one woofer. Each chamber contains a pivotally installed divider. A nut mounted on the divider is threadedly connected to a bolt which is rotated by a motor and which is mounted to the rear wall of the speaker box. Thus, when the motor rotates the bolt, the divider is pulled toward or pushed away from the rear wall of the speaker box. Regardless of the position, the moveable divider is a virtual rear wall of the volume and therefore defines the volume available for amplified bass. Another embodiment is a cylindrically shaped wooden tube which houses only one woofer. In much the same way as described for the rectangular speaker box, a circular divider is mounted within—allowing the amount of interior space used by the speaker to be adjusted.

1 Claim, 4 Drawing Sheets

ADJUSTABLE SPEAKER BOX

FIELD OF THE INVENTION

The present invention generally relates to a speaker box, particularly to a speaker box which is able to adjust the amount of interior space used.

BACKGROUND OF THE INVENTION

It is a commonly known fact that speakers require some sort of exterior means by which to vibrate. Large bass speakers, more commonly called "woofers", have recently become very popular among the younger generation. Woofers, which are used to greatly amplify the lower registers of music such as rap and hip-hop, require a large space in which to vibrate and are thus attached to large, wooden boxes. These large speaker boxes are specifically designed to be used in the trunk of an automobile. While the greatly amplified bass produced by these speaker boxes works well with rap and hip-hop, it does not sound very good with music such as classical and opera, which do not require nearly as much bass. Thus, when one who is driving a car wishes to listen to music such as classical or opera, he or she has no choice but to listen to the large, bass-oriented speaker box which is installed in the trunk of the automobile.

Many speaker boxes have been designed with a large volume in order to provide greatly amplified bass. Many speaker boxes have also been designed with a smaller volume for the purpose of providing a normal amount of bass. There is no existing speaker box, however, which is able to provide both greatly amplified bass and normal bass.

SUMMARY OF THE INVENTION

The present invention solves the problems described above by providing an automobile speaker box which is able to adjust the amount of interior space being used.

Two preferred embodiments of the present invention are described herein, both of which utilize the same space adjustment principle.

The first embodiment is a large, rectangularly shaped wooden speaker box which is centrally partitioned into two separate chambers, each of which houses one woofer. Each chamber also contains a pivotally installed divider. A nut mounted within the divider is threadedly connected to a bolt which is rotated by a motor attached to the rear wall of the speaker box. Thus, when the motor revolves the bolt, the divider is pulled toward or pushed away from the rear wall of the speaker box. The moveable divider acts as a substitute for the rear wall of the speaker box, thereby adjusting the amount of interior space used by the speaker.

The second embodiment is only a slight variation of the first speaker box described. This speaker box is a cylindrically shaped wooden tube which houses only one woofer. A circular divider is mounted within in much the same way as described above for the rectangular speaker box, allowing the amount of interior space used by the speaker to be adjusted.

It is therefore a primary object of the present invention to provide a speaker box which is able to adjust the amount of interior space being used.

It is a further object of the present invention to provide a speaker box which produces greatly amplified bass.

It is another object of the present invention to provide a speaker box which produces a normal amount of bass.

It is another object of the present invention to provide a rectangularly shaped speaker box centrally partitioned into two separate chambers.

It is another object of the present invention to provide a cylindrically shaped speaker tube.

It is another object of the present invention to provide movable dividers within said speaker box and speaker tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE PREFERRED EMBODIMENTS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
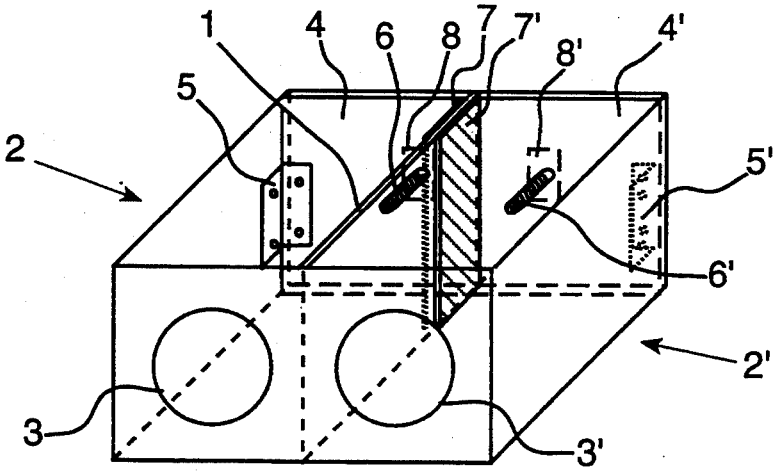
FIG. 1 is a view of the presently invented rectangular speaker box in its amplified bass mode.

Referring now to FIG. 1, a rectangular speaker box is shown. A central partition 1 separates the box into chambers 2 and 2'. A speaker hole 3 is centrally positioned in the front wall of chamber 2. A divider 4 is attached to a hinge 5 which is affixed to the far left corner of the chamber. A bolt 6 is threadedly attached to a nut assembly 8 installed within divider 4. The bolt 6 is presently holding the divider 4 against the rear wall of chamber 2. As a result, a cardboard extension 7, which is attached to the divider 4, is pressing against the central partition 1 at a 90 degree angle to the divider 4. A speaker hole 3' is centrally positioned in the front wall of chamber 2'. A divider 4' is attached to a hinge 5' which is affixed to the far right corner of the chamber. A bolt 6' is threadedly attached to a nut assembly 8' installed within divider 4'. The bolt 6' is presently holding the divider 4' against the rear wall of chamber 2'. As a result, a cardboard extension 7', which is attached to the divider 4', is pressing against the central partition 1 at a 90 degree angle to the divider 4'. The speaker box is presently in its amplified bass mode.

Figure 2:
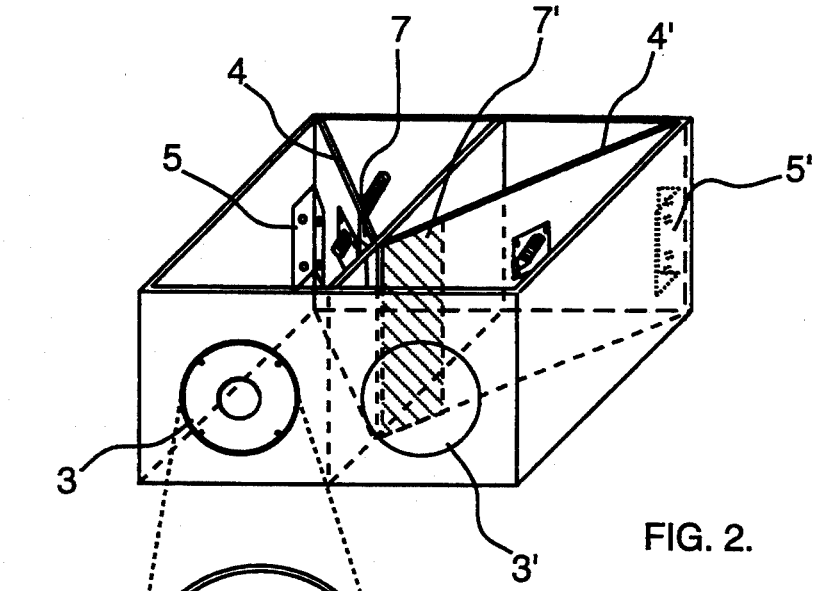
FIG. 2 is a view of the presently invented rectangular speaker box in its normal bass mode.
Figure 8:
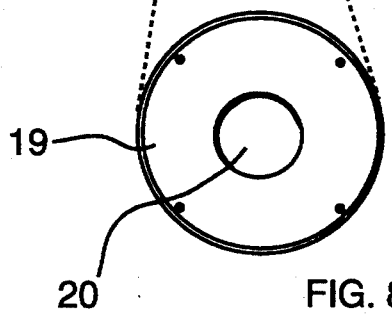
FIG. 8 is a view of speaker cover with a hole in the center.

Referring now to FIG. 2, the rectangular speaker box from FIG. 1 is now shown in its normal bass mode. Notice that the side of the dividers 4 and 4' with cardboard extensions 7 and 7' have been moved toward the speaker holes 3 and 3', respectively, while the side of the dividers 4 and 4' attached to the hinges 5 and 5', respectively, have remained in the same position as before. The cardboard extensions 7 and 7' are now in their fully extended position. Also, a speaker cover has been inserted into speaker hole 3. Per FIG. 8, this speaker cover comprises a transparent plastic outer ring 19 with a hole 20 in the center, and may be used in speaker hole 3' in the same manner.

Figure 3:
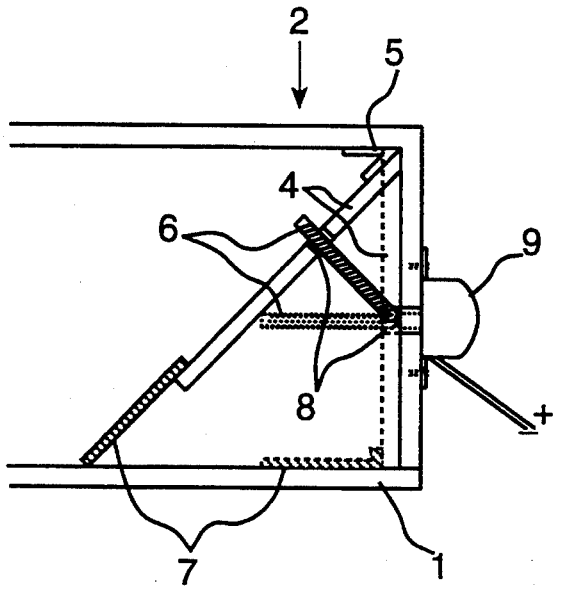
FIG. 3 is a sectional top view of the speaker box shown in FIGS. 1 and 2.
Figure 4:
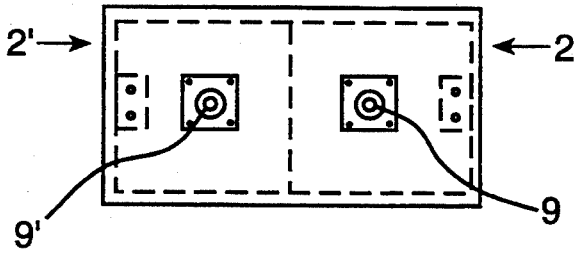
FIG. 4 is a rear view of the speaker box shown in FIGS. 1, 2, and 3.

The cardboard extensions 7 and 7' are attached to the dividers 4 and 4' in such a way that their most natural position is to be coplanar with the dividers. Thus, they naturally gravitate toward this position. This is more clearly shown in FIG. 3, which shows a top view of chamber 2. When the divider 4 is resting against the rear wall of the speaker box, the cardboard extension 7 presses against the central partition 1 at a 90 degree angle to the divider 4. A motor 9 is attached to the outside of the rear wall of the speaker box, as shown in FIG. 4. This motor 9 may be powered by either a 12 volt DC current or a 120 volt AC current, whichever is available. As the motor 9 turns the bolt 6 counter-clockwise, the threads of the bolt 6 rotate within the threads of the nut assembly 8. This causes the nut assembly 8 to move axially along the length of the bolt 6, away from the motor 9. As a result, the divider 4, in which the nut assembly 8 is installed, is pushed away from the rear wall of the speaker box. Only the side of the divider 4 which is attached to the extension 7 moves, however, because the opposite side is attached to the stationary hinge 5. Thus, as the divider is being pushed away from the rear wall of the speaker box, a space is created between the divider 4 and the central partition 1. The cardboard extension 7 fills this space by naturally and continuously pressing against the central partition 1. If the cardboard extension 7 becomes weak and does not completely fill the space, the air inherently generated by the speaker will force the extension 7 into place, thereby sealing the chamber.

Figure 5:
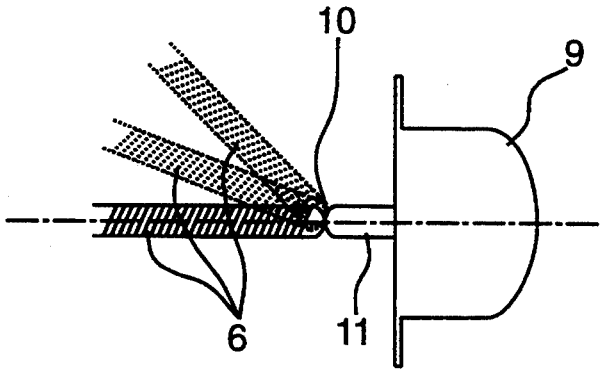
FIG. 5 is a detailed and exploded top view of the joint mechanism of the presently invented speaker box.

As the divider 4 is pushed away from the rear wall of the speaker box, creating an angle between the divider 4 and the rear wall, the nut assembly 8 within the divider 4 gradually digresses from the original axis of the bolt 6. A joint 10, shown in FIG. 5, has therefore been provided to adjust to this factor. With the joint 10, the motor is able to rotate the bolt 6 no matter what angle exists between the bolt 6 and the bolt base 11. The joint 10 used in the present invention comprises two half-rings which are hooked together, although a better joint may be used as the need arises. Thus, the bolt 6 is able to adapt to the changing position of the nut assembly 8. A stopping means may be provided on the tip of the bolt 6 to prevent the divider 4 from coming off of the bolt 6, although this is not crucial to the present invention.

The functions of chamber 2' are exactly the same as those of chamber 2 except that all of the elements of chamber 2' are placed directly opposite their corresponding elements in chamber 2. Furthermore, either chamber can operate independently of the other. For example, chamber 2 may be in its amplified bass mode while chamber 2' is in its normal bass mode. Chamber 2 is primarily referred to in these specifications simply for reference purposes.

Figure 6:
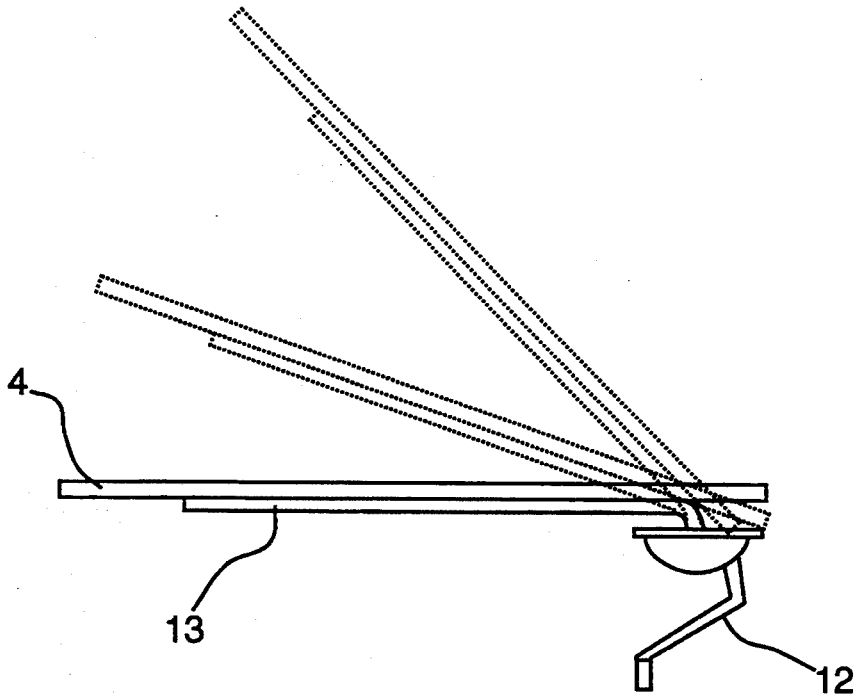
FIG. 6 is an alternative method for moving the dividers of the presently invented speaker box.

Referring now to FIG. 6, an alternative method is shown for moving the divider 4. This is the same method used in many conventional windows. When the handle 12 is manually turned clockwise, the arm 13 swings outward. When the handle 12 is turned counter-clockwise, the arm 13 swings inward. If the divider 4 is attached to the arm 13, this method will work in much the same way as the assembly described above. This method, although less convenient, will be less expensive to manufacture than the above described assembly.

Figure 7:
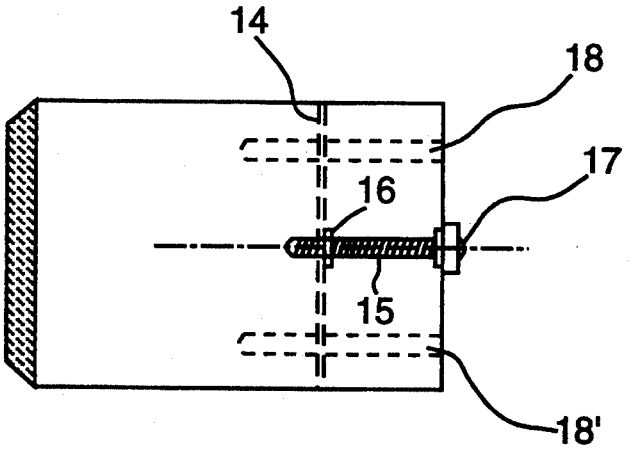
FIG. 7 is a top view of the presently invented speaker tube.

Referring now to FIG. 7, another embodiment of the present invention is shown. This speaker tube is of a cylindrical rather than rectangular shape and holds one speaker rather than two. A circular divider 14 is mounted onto a bolt 15 by means of an internally installed nut assembly 16. This nut and bolt system works in much the same way as the system described above for the rectangular speaker box. The divider 14 is further mounted onto two rods 18 and 18', which prevent the divider from rotating. Thus, when the bolt 15 is rotated by an externally mounted motor 17, the threads of the bolt 15 rotate within the threads of the nut assembly 16, causing the divider 14 to move along the parallel axes of the bolt 15 and the rods 18 and 18'. An extension is unnecessary because the entire divider moves rather than only one side. This prevents any space from being created between the divider and the walls of the speaker tube.

I claim:

1. A speaker box which is able to adjust the amount of interior space used, comprising:

a rectangular box;

a partition separating said box into two chambers;

a speaker hole in the front of each of said chambers;

a speaker cover installed over each of said speaker holes, each said speaker cover comprising a transparent plastic outer ring with a hole in the center;

a divider pivotally mounted to the rear of each of said chambers;

a nut assembly installed within each of said dividers;

a bolt threadedly attached to each of said nut assemblies;

a motor connected to the rear wall of each of said chambers for rotating each of said bolts;

a cardboard extension attached to each of said dividers.

* * * * *